US005158212A

United States Patent [19]

Sirhan

[11] Patent Number: 5,158,212

[45] Date of Patent: Oct. 27, 1992

[54] HANDS FREE AMUSEMENT DEVICE

[76] Inventor: Eddie A. Sirhan, 2410 Olympic Dr., South San Francisco, Calif. 94080

[21] Appl. No.: 671,006

[22] Filed: Mar. 18, 1991

[51] Int. Cl.[5] ..... B67D 5/64

[52] U.S. Cl. ..... 222/175; 222/192; 222/333; 273/DIG. 17; 273/349; 446/175; 446/475

[58] Field of Search ..... 222/78, 79, 175, 192, 222/333; 2/185 R, 196, 199, 209.1; 239/152, 153, 154; 273/DIG. 17, 349; 446/175, 473, 475

[56] References Cited

U.S. PATENT DOCUMENTS

| | | | |
|---|---|---|---|
| 2,640,980 | 6/1953 | Prupis | 2/185 R |
| 3,352,364 | 11/1967 | De Coste | 239/152 X |
| 3,440,349 | 4/1969 | Gibbs | 446/175 X |
| 4,586,280 | 5/1986 | Dane | 2/185 R X |
| 4,739,905 | 4/1988 | Nelson | 222/175 X |
| 4,801,088 | 1/1989 | Baker | 222/333 X |
| 4,807,813 | 2/1989 | Coleman | 222/175 X |
| 4,903,864 | 2/1990 | Sirhan | 222/78 |
| 4,925,105 | 5/1990 | Lin | 222/175 X |
| 4,988,111 | 1/1991 | Gevlizt et al. | 273/DIG. 17 X |

*Primary Examiner*—Andres Kashnikow
*Assistant Examiner*—Kenneth Bomberg
*Attorney, Agent, or Firm*—Douglas A. Chaikin

[57] ABSTRACT

Disclosed herein is an amusement device for squirting liquid. The amusement device includes a helmet having a squirt assembly connected thereto. The squirt assembly may be connected to a pump and a storage container for liquid via an umbilical cord as found in Sirhan, U.S. Pat. No. 4,903,864. The squirt assembly has a conduit extension connected to the umbilical cord. The squirt assembly further includes an aiming assembly supporting the conduit extension. The aiming assembly includes an azimuth and an elevation adjust for adjusting the conduit extension. A voice activated circuit activates and de-activates the pump upon receipt of an valid voice command. Upon receipt of a valid voice command, the pump is activated, liquid is pumped from the container to helmet through the umbilical cord and exits through the conduit extension, thereby enabling the hands free operation of the amusement device.

13 Claims, 3 Drawing Sheets

HANDS FREE AMUSEMENT DEVICE

BACKGROUND OF THE INVENTION

1. Field of the Invention:

This invention relates to amusement devices and more particularly to a hands free amusement device mounted on the head of a user for squirting liquids.

2. Previous Art

As disclosed in Sirhan, U.S. Pat. No. 4,903,864 the Background of which is specifically incorporated herein by reference, there are many amusement devices for squirting liquids. However, there exists no such amusement device which satisfies the need to keep the user's hands entirely free while operating the device. In fact, in Sirhan, supra, it was disclosed to provide a glove having a trigger and a portable water supply, which at least partially kept the user's hands free. As pointed in Sirhan, supra, it is important like. Sirhan, supra, makes a clear advance over the art while not completely satisfying this need.

Sirhan, supra also makes a clear advance over the art in the area of safety, which is of vital concern in amusement devices of this type since they are often used by children. While typical squirt devices are made from high impact and very hard and rigid plastic material, Sirhan, supra is flexible and unlikely to cause multiple users engaged in squirt competitions injury. However, no provision was made in Sirhan, supra for protection from collision from other competitors and the like. Thus, a participant in such a competition could be struck either accidentally or on purpose, be knocked down and have no protection from the Sirhan, supra device.

Sirhan, supra also advances the art because it aids in preventing the misidentification of squirt devices for real weapons. As is well known, and as is described in Sirhan, supra, squirt devices are commonly sold in the shape of real weapons such as a 9 mm and 0.45 cal. hand guns as well as M-16's and Uzzi's. There have been reported instances where the police or other law enforcement officials as well as others have mistaken such realistic looking amusement devices for real weapons with tragic consequences. Since Sirhan, supra is in the shape of a glove such misidentification is not possible.

In summary, there exists no amusement device which enables a user to have a hands free operation while providing a user with a safety device during collisions and which continues the tradition started in Sirhan, supra of preventing the misidentification of squirt devices as real weapons. The invention herein is designed to provide a squirt amusement device which satisfies this need and retains the fun and spontaneity of traditional squirt devices.

SUMMARY OF THE INVENTION

It is an object of this invention to provide a hands free amusement device for squirting liquid.

It is a further object of this invention to provide such an amusement device which may be used safely in competition, even where the competition include collisions between competitors.

It is a further object of this invention to provide such an amusement device which prevents the squirt device from being mistaken for a real weapon.

In accordance with the above objects and those that will be mentioned and will become apparent below, the amusement device in accordance with this invention, comprises:

a helmet including a squirt assembly connected to the helmet, the squirt assembly connected to a pump and a container via an umbilical cord, the squirt assembly having a conduit extension connected to the umbilical cord, the squirt assembly including an aiming assembly supporting the conduit extension, the aiming assembly having an azimuth and elevation adjust means for adjusting the conduit extension; and a voice activated circuit for activating and de-activating the pump upon receipt of an valid voice command, whereby, upon a valid voice command the pump is activated, liquid is pumped from the container to helmet through the umbilical cord and exiting through the conduit extension, thereby the operation of the amusement device is hands free.

In accordance with the above objects and those that will be mentioned and will become apparent below, another embodiment of the amusement device in accordance with this invention, comprises:

a helmet;

a container suitable for holding liquids including a pump means;

an umbilical cord connecting the pump means to the container; and means for squirting a liquid, the means mounted on the helmet, the squirting means including a voice-activated circuit for activating the pump means, and the pump means for pumping liquid from the container to the squirting means, whereby, upon voice activation of the pump, liquid may be pumped from the container to helmet squirting means and fired therefrom, whereby the operation of the amusement device is hands free.

In a first preferred embodiment, the aiming means may be tailored to suit the eyesight and needs of the individual user. Both the azimuth and the elevation are adjustable by appropriate structure, described in detail below. The ability to make such adjustments enables the squirt assembly to squirt a stream of liquid to the desired target with acceptable accuracy. In a still further preferred embodiment, the voice activated means includes a microphone connected to a voice activated circuit and a voice activated switch. Upon a valid voice command through the microphone, the circuit is activated or de-activated. An additional feature in this preferred embodiment is that after being activated, the circuit can automatically be de-activated by a time delay within the circuit. For example, after voice activation, the circuit will be de-activated a predetermined time such as 15 seconds, 30 seconds or 45 seconds.

In addition, the above embodiment also may include a face guard made of sun blocking material which pivots on the helmet. Additionally, to assist in aiming the device in accordance with this invention a cross-hair circle is included on the face guard.

In another preferred embodiment of the invention, the helmet is made from high impact plastic to prevent head injury in case of a collision and/or fall. The construction of the helmet also adds to the invention's longevity and durability as well as reliability.

In all of the preferred embodiments described above it is preferred to have the electrical and fluid conduit lines bundled together from the container to the pump and helmet.

It is an advantage of this invention to provide a helmet amusement device which is suitable for use in organized water sport competitions.

It is an additional advantage of this invention to provide a safe and effective hands free water amusement device which allows the user to operate other squirt devices while operating the device of the instant invention.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
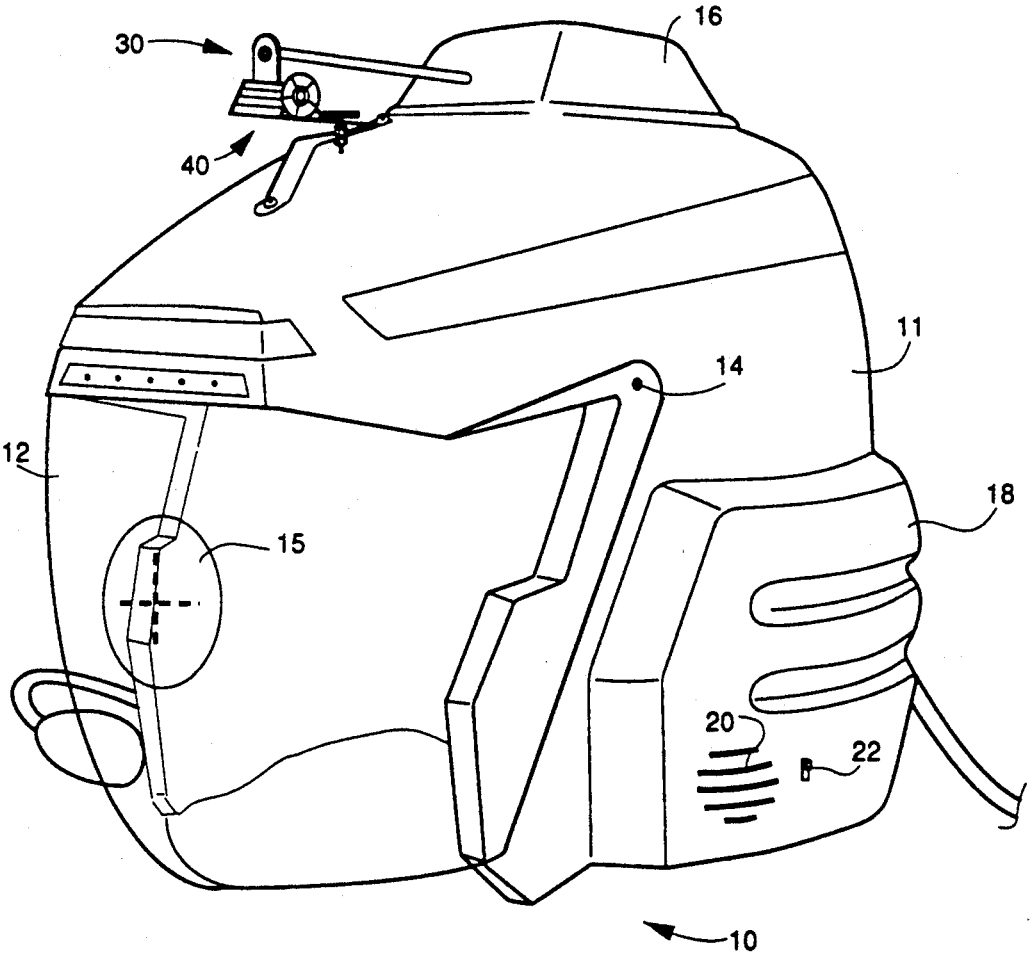
FIG. 1 is a perspective view of the amusement device in accordance with this invention.

The invention will be described in detail with respect to using water as the only liquid. It will be understood that this is done only for the purposes of understanding and that other suitable liquids such as a water-based dye, juices of various kinds, e.g. apple or grape, as well as other liquids may be used with equal effectiveness. It will further be appreciated that several of the elements of one of the claims are not shown in the immediate drawing of this specification. These elements include the pump and the water supply. These elements are shown and described in detail in Sirhan, supra and the description and drawing of Sirhan, supra is specifically incorporated herein by reference. The elements of Sirhan, supra are identical to the like elements of this specification and work in a like manner.

The invention will now be described with respect FIG. 1 wherein the helmet amusement device in accordance with this invention is shown generally by the numeral 10. The helmet amusement device 10 includes a helmet 11 and a face guard 12 hinged to the helmet at hinge 14. The face guard 12 has a cross-hair circle 15.

Additionally, the helmet amusement device 10 includes the separable and portable water supply container and pump (not shown) of Sirhan, supra. The water supply and pump are connected to an umbilical cord 80 and work in the same manner as described in Sirhan, supra.

The face guard 12 is preferably made from the same plastic material used to make sun glasses and is preferably a dark color and polarized to filter light. The dark color allows the user to see out and while preventing others from seeing inside the helmet 11 adding to the competitive value of the helmet amusement device 10. These features also add to the safety and attractiveness of the helmet 11. Additionally, the face guard 12 pivots and can be easily raised and lowered for donning and removal of the helmet.

The cross-hair circle 15 is a decal type of material having an adhesive on one side. The cross-hair circle 15 attaches easily to the face guard 12 by applying the circle to the face guard 12 with the adhesive. The cross-hairs are heavily lined so they stand out from the dark material of the face guard. The cross-hair circle 15 assists the user in aiming the helmet 11 toward the desired target. Alternatively, the cross-hairs may be etched on the face guard 12.

The helmet 11 further includes a light assembly 16 which can be activated synchronously with a voice activated circuit as will be more apparent below. The light assembly 16 is connected to the top of the helmet 11 and is sealed to prevent leakage and thereby premature corrosion and break down. The light assembly 16 includes a light and the appropriate circuitry as will be appreciated by those skilled in the art.

The helmet 11 includes a circuit enclosure 18 for enclosing a voice activated circuit 90. The enclosure 18 is connected and sealed to the rear of the helmet 11. The enclosure 18 is removable to give access to the voice activated circuit for repair or for making adjustments as desired. Additionally, the enclosure 18 protects the voice activated circuit from other physical damage such as during a collision.

The enclosure 18 has a set of openings located on each side of the helmet 11 defining cooling vents 20. The cooling vents 20 provide means for the convection cooling of the voice-activated circuit 90. Additionally, the helmet 11 includes an on/off switch 22 for enabling the voice activated circuit 90. When the switch 22 is placed in the "on" position, the pump may be activated by a voice command as will be more fully appreciated hereinafter. Alternatively, the pump may be triggered by a manual trigger by placing the switch 22 in the "off" position.

Figure 2:
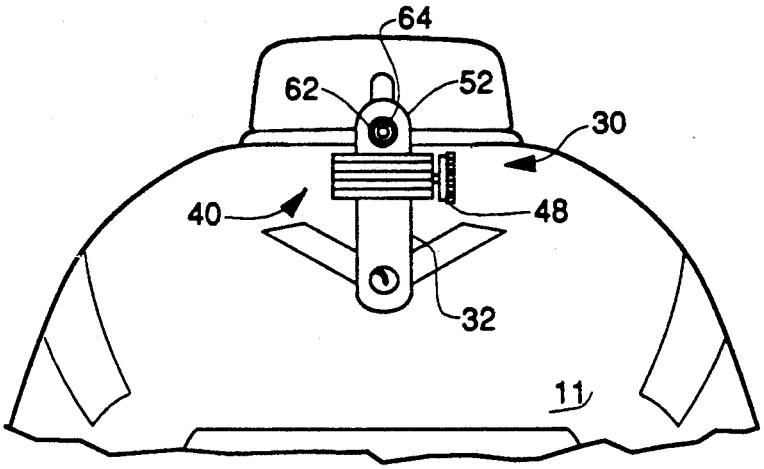
FIG. 2 is a sectional front elevational view of the helmet of FIG. 1.
Figure 3:
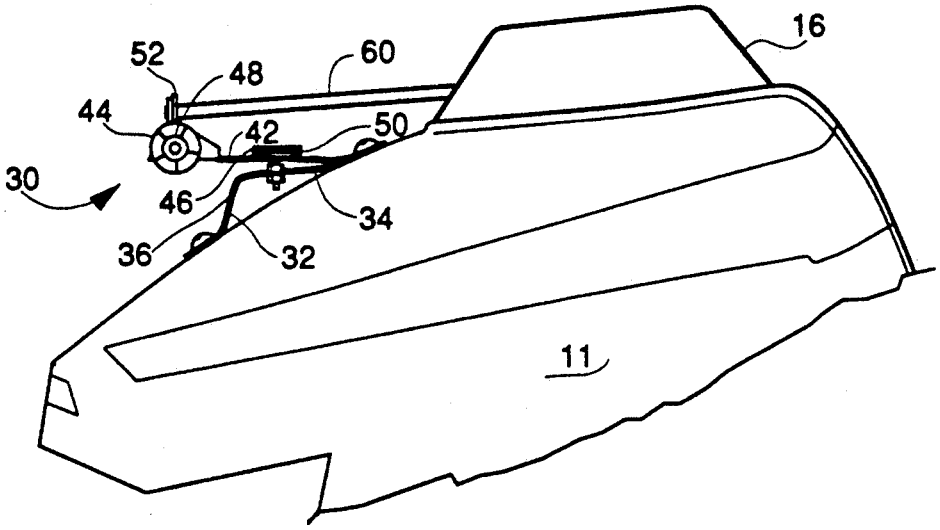
FIG. 3 is a sectional side elevational view of the helmet of FIG. 1.

The helmet amusement device 10 includes a squirt assembly shown generally by the numeral 30 in FIG. 1 and in more detail in FIGS. 2 and 3. The squirt assembly 30 includes a helmet support bracket 32. The support bracket 32 includes a first leg 34 and second leg 36. The legs 34 and 36 are bent to fit compatibly on the helmet 11. It will be appreciated that on the helmet 11 shown in the drawing, the legs 34 and 36 are approximately perpendicular to one another. On a different helmet, the legs 34 and 36 would be bent appropriately to accommodate secure fitting of the squirt assembly 30 to the helmet 11.

Each leg 34 and 36 has an opening at its distal end for accommodating a screw. A screw is threaded through the opening and screwed into the helmet 11 for securing the squirt assembly 30 to the helmet 11.

The squirt assembly 30 includes an aiming assembly generally denoted by the numeral 40. The aiming assembly 40 includes an aiming arm 42 connected to the support bracket 32. The aiming arm 42 has an opening at its distal end. The screw connecting the first leg 34 of the support bracket 32 to the helmet 11 is similarly threaded through the opening at the distal end of the aiming arm 42 for securing the aiming assembly to the helmet 11.

The aiming assembly 40 includes an azimuth adjust 44 and a elevation adjust 46. The azimuth adjust 44 includes an adjustment knob 48 for aiming the stream of water output from the helmet amusement device 10 in a side to side fashion. The elevation adjust 46 similarly includes an adjustment knob 50 for adjusting the height of the output of the water stream.

The aiming assembly 40 further includes an end bracket 52. The end bracket 52 has an opening for supporting a conduit extension 60. The conduit extension 60 extends the umbilical cord 80 through the helmet 11, thereby connecting the helmet 11 to the water supply. The conduit extension 60 includes an end cap 62. The end cap 62 has an opening 64 for squirting water therethrough. The end cap 62 enables the helmet amusement device 10 to build up water pressure for squirting a hard pulsating stream of water therethrough because the opening 64 in the end cap 62 is many times smaller than the inside diameter of conduit extension 60 or umbilical cord 80. For example, the diameter "d" of the conduit extension and the umbilical cord is approximately 0.25", while the opening of the end cap 62 is approximately $5.95\times10^{-4}$ or d/420. Additional preferred ratios of "d" to the size of the opening are found in Sirhan, supra.

IN USE:

As the knob 48 is turned clockwise, the conduit extension 60 shifts to the right when the helmet amusement device 10 is in an upright position. Similarly, as the knob 48 is turned counter-clockwise, the conduit extension 60 shifts to the left. Likewise, when the elevation adjust knob 50 is turned clockwise, the conduit extension 60 is raised. And, when the knob 50 is turned counter clockwise, the conduit extension 60 is lowered.

Together with the squirt assembly 30, the aiming assembly 40 and the user himself, approximate centering of the "squirted" stream on a selected target with reference to cross hair circle 15 can be achieved.

Figure 4:
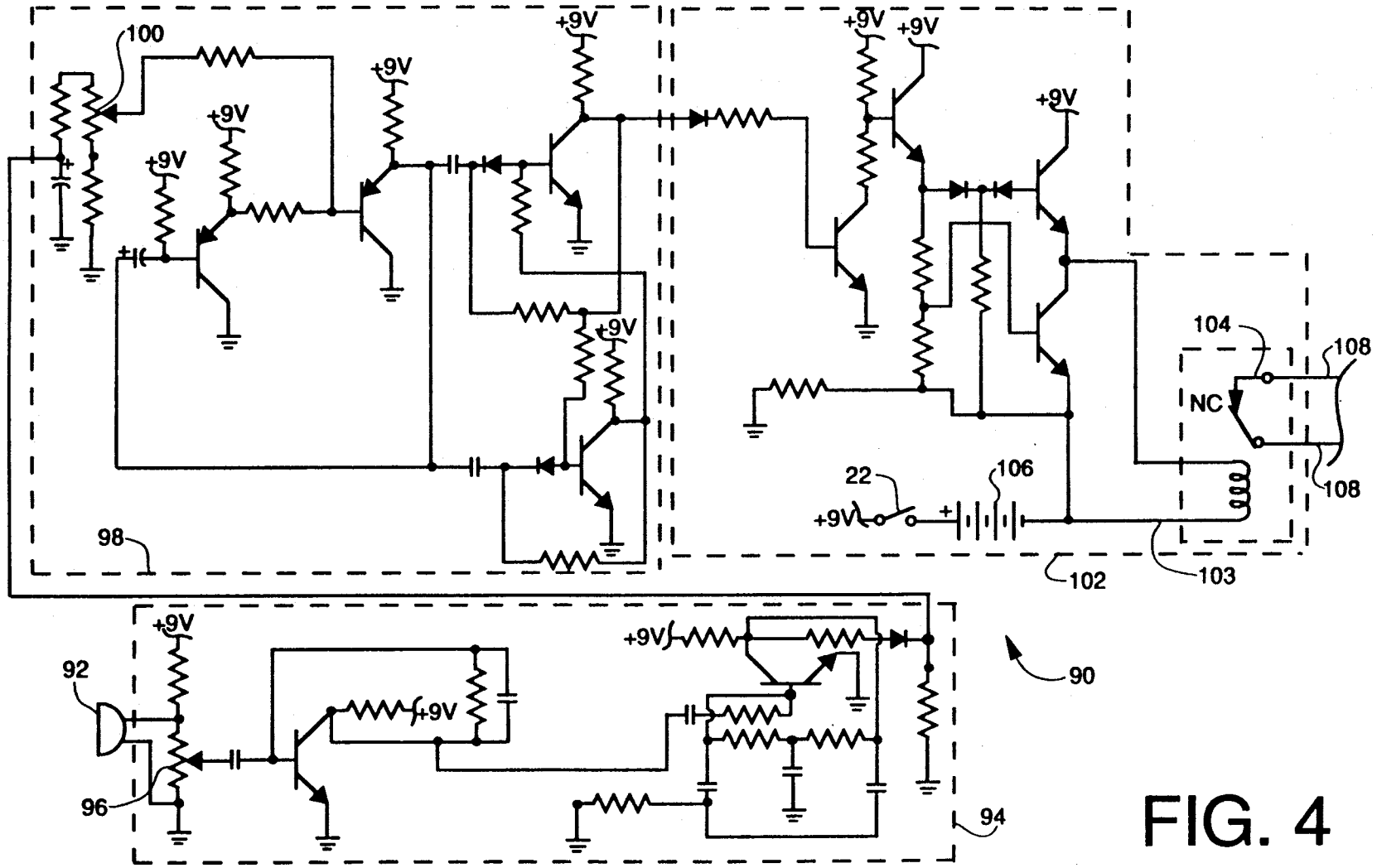
FIG. 4 is a electrical schematic diagram of the voice-activated trigger circuit in accordance with the present invention.

The voice activated circuit is generally shown by the numeral 90 in FIG. 4. The voice activated circuit 90 includes a microphone 92 located on one side of the helmet 11 as best shown in FIG. 1.

The voice-activated circuit is generally shown by the numeral 90 in FIG. 4. The voice-activated circuit 90 includes a 9-volt battery 106 which supplies operating power for the circuit when the on/off switch 22 is placed in the "on" position.

The voice-activated circuit 90 includes a microphone 92 located on one side of the helmet 11 as best seen in FIG. 1. The microphone 92 is positioned within the space defined by lowered face guard 12 to provide maximum pickup of the voice command and to exclude most extraneous sounds, thereby preventing inadvertent activation such as by the shouts of an opponent and insuring the receipt of a valid voice command.

The microphone 92, shown schematically in FIG. 4, receives a valid voice command which activates the circuit 90 and causes the squirting of water. As will be seen below, a first voice command will start the pump cycle, and the following voice command will stop the pump cycle.

Though not incorporated in the preferred embodiment of the circuit 90, it is within the scope of the present invention that recognition of voice commands of various kinds be encoded into voiceactivated circuit 90. For example, the voice command "start" can be made to activate the squirting of water. In similar manner, the voice command "stop" can be encoded within voice-activated circuit 90 to de-activate the discharge of water.

As shown in FIG. 4, the voice-activated circuit 90 includes the microphone 92 and a detection and amplification circuit 94. The output of the microphone 92 is applied as input to the detection and amplification circuit 94 across a sensitivity threshold adjust member 96. The sensitivity threshold adjust member 96 is adjusted so that the voice-activated circuit 90 will be responsive to valid voice commands and will not be activated by inappropriate background noises such as the sound of the user's breathing. The sensitivity threshold adjust member 96 selects a portion of the output of the microphone 92 and applies it to the remainder of the detection and amplification circuit 94 which amplifies the signal before it is output by the detection and amplification circuit 94.

The voice-activated circuit 90 includes an integration and toggle circuit 98. The output of the detection and amplification circuit 94 is the input to the integration and toggle circuit 98. The integration and toggle circuit 98 includes potentiometer 100 which establishes the rate of integration of the integration and toggle circuit 98. The potentiometer 100 is adjusted so that only those sounds which exceed some minimum duration will activate the voice-activated circuit 90. Typically the potentiometer 100 is adjusted so that these will be sounds lasting longer than a few hundred milli-seconds.

The sensitivity threshold adjust member 96 and the potentiometer 100 are adjusted so that the voice-activated circuit 90 will "filter out" sounds which are too soft or of too short duration to be recognized as a valid voice command.

In the preferred embodiment, both the sensitivity threshold adjust member 96 and the potentiometer 100 are screwdriver-adjusted and are preset rather than being available to the user. It is within the scope of the present invention that the sensitivity threshold adjust member 96 and/or the potentiometer 100 may be replaced individually by a series of fixed resistors whose values are selected to achieve the stated purposes.

When a first voice command is received by the microphone 92 and amplified by the detection and amplification circuit 94 producing an input to the integration and toggle circuit 98, the output of the integration and toggle circuit 98 will turn "on." A second voice command will cause the output of the integration and toggle circuit 98 to turn "off." Each succeeding voice command will cause the output of the integration and toggle circuit 98 to "toggle" or "reverse state." It will be seen below that this sequence of actions will alternately "start" and "stop" the pump cycle, and hence the discharge of water.

The voice-activated circuit 90 includes a pump relay driver circuit 102. The output of the integration and toggle circuit 98 is the input to the pump relay driver circuit 102. The pump relay driver circuit 102 includes a pum relay 103 having a pair of normally closed contacts 104 which are held open in the absence of an output from the integration and toggle circuit 98. When the contacts 104 are held open, the pump does not cycle and no water is discharged from the squirt assembly 30.

When the output of the integration and toggle circuit 98 is "on," the relay driver circuit 102 will cause the pump relay 103 to become inactive, allowing the normally closed contacts 104 to close. This action will complete an electrical circuit between the pair of wires 108 which provide the trigger input to the electromechanical pump located in the separable liquid storage apparatus of Sirhan, supra. Under these conditions, the pump will cause water to be discharged from the squirt assembly 30 on the helmet 11. Thus it will be seen that an "active" or "on" output from the integration and toggle circuit 98 results in water being discharged from the helmet amusement device 10 in accordance with the present invention.

It may be further seen that the action of the pump relay 103 and the normally closed contacts 104 is to "invert" or reverse the meaning of the output of the integration and toggle circuit 98. That is, an "active"

output from the integration and toggle circuit 98 means "pump water." But an active output from the integration and toggle circuit 98 causes the pump relay 103 to remain inactive and the normally closed contacts 104 to remain in their closed position. This arrangement is a specific design feature of the preferred embodiment of the present invention. Its purpose is to provide a fail safe means for manually operating the pump in the event of a malfunction of the voice-activated circuit 90 as might typically be caused by a fully discharged 9-volt battery 106. If the voice-activated circuit 90 is rendered inoperative by reason of malfunction or by reason of the on/-off switch 22 being placed in its "off" position, the normally closed contacts 104 will remain closed. In this condition, the pump may be controlled by operating the on/off switch (not shown) located on the separable liquid storage apparatus as described in Sirhan, supra.

The umbilical cord 80, as best shown in FIG. 1, is used to bundle together the liquid conduit and the electrical wires 108 as previously disclosed in Sirhan, supra, and is specifically incorporated herein by reference.

While the foregoing detailed description has described only one embodiment of the amusement device in accordance with this invention, it is to be understood that the above description is illustrative only and not limiting of the disclosed invention. Particularly, other embodiments are possible. Notably, the structure and arrangement of the liquid squirting means could be disposed at different locations on the helmet or be of markedly different design and be within the scope and spirit of this invention. It will be appreciated that the voice-activated trigger circuit may be constructed using a different technology than the discrete components employed, and might incorporate the delay circuit for controlling pump cycles. It will be further appreciated that the "flashing" light located on helmet 11 might be included in the invention. Thus the invention is to be limited only by the claims as set forth below.

What is claimed is:

1. An amusement device for squirting liquid from a container having a pump and umbilical cord extending therefrom for transporting liquid therethrough, the amusement device comprising:

a helmet including a squirt assembly connected to the helmet, the squirt assembly connected to the pump and the container via the umbilical cord, the squirt assembly having a conduit extension connected to the umbilical cord, the squirt assembly including an aiming assembly supporting the conduit extension, the aiming assembly having an azimuth and elevation adjust means for adjusting the conduit extension; and a voice activated circuit for activating and de-activating the pump upon receipt of an valid voice command, whereby, upon valid voice command the pump is activated, liquid is pumped from the container to helmet through the umbilical cord and exiting through the conduit extension, thereby the operation of the amusement device is hands free.

2. An amusement device for squirting liquid as set forth in claim 1, wherein the squirt assembly includes a support bracket having a first and second leg mechanically connected to the helmet.

3. An amusement device for squirting liquid as set forth in claim 2, wherein the aiming assembly has an aiming arm which is connected to the first leg.

4. An amusement device for squirting liquid as set forth in claim 3, wherein the aiming assembly has an end support bracket approximately perpendicular to the aiming arm and wherein the end support bracket supports the conduit extension.

5. An amusement device for squirting liquid as set forth in claim 4, wherein the conduit extension has an end cap having a predetermined diameter "d" and the end cap has an opening of diameter "d"/420.

6. An amusement device for squirting liquid as set forth in claim 1, wherein the helmet includes a face guard which pivots about the helmet and wherein the face guard has a cross-hair circle for assisting in aiming the device.

7. An amusement device for squirting liquid as set forth in claim 1, wherein the helmet includes a removable and sealable enclosure for enclosing the voice activated circuit and thereby protecting the same.

8. An amusement device for squirting liquid as set forth in claim 7, wherein the enclosure has a series of cooling vents.

9. An amusement device for squirting liquid as set forth in claim 8, wherein the enclosure includes an on/-off switch accessible from the outside of the helmet for enabling and disabling the a voice activated circuit.

10. An amusement device for squirting liquid as set forth in claim 6, wherein the voice activated circuit includes a microphone and wherein the microphone fits fully within the space of the face guard.

11. An amusement device for squirting liquid as set forth in claim 1, wherein the voice activated circuit comprises:

an on/off switch for enabling the voice activated circuit;

a portable battery for powering the circuit;

a microphone;

an amplification/detection circuit for detecting a valid voice command from an output of the microphone;

an integration and toggle circuit for filtering out extraneous noise and insuring a valid voice command, the integration and toggle circuit receives any output of the detection and amplification circuit and determines whether the output has been sustained for a long enough period of time to be a valid voice command; and a pump relay driver circuit including a driver and a pump relay having normally closed contacts, the pump relay driver circuit receives any output of the integration and toggle circuit, the relay contacts are pulled open as long as no output is detected from the integration and toggle circuit, upon the detection of an output from the integration and toggle circuit as a result of a valid voice command, the driver releases the normally closed contacts allowing the pump to be activated when the "on/off" switch enables the circuit.

12. An amusement device for squirting liquid as set forth in claim 11, wherein the voice activated circuit includes a means for adjusting the percentage of output of the microphone which is received.

13. An amusement device for squirting liquid as set forth in claim 12, wherein the voice activated circuit includes a means for adjusting the minimum time period for determining whether a valid voice command has been received.

* * * * *